US005647583A

United States Patent [19]

Emigh et al.

[11] Patent Number: 5,647,583

[45] Date of Patent: Jul. 15, 1997

[54] APPARATUS AND METHOD FOR SINGULATING SHEETS AND INSERTING SAME INTO ENVELOPES

[75] Inventors: Jonathan D. Emigh; Raymond P. Porter, both of Somerset; Motaz M. Qutub, Rancho Cordova, all of Calif.

[73] Assignee: North American Capital L.L.C., San Diego, Calif.

[21] Appl. No.: 540,384

[22] Filed: Oct. 6, 1995

[51] Int. Cl.[6] ..... B65H 39/00

[52] U.S. Cl. ..... 270/52.04; 270/58.03; 271/14; 271/263; 53/53; 53/493

[58] Field of Search ..... 270/52.04, 52.05, 270/52.06, 52.15, 52.29, 58.02, 58.03; 271/11, 14, 85, 263, 265.04; 53/53, 54, 493

[56] References Cited

U.S. PATENT DOCUMENTS

| | | | |
|---|---|---|---|
| 2,325,455 | 7/1943 | Williams . | |
| 3,371,331 | 2/1968 | Buckholz | 271/263 X |
| 3,885,780 | 5/1975 | Morrison | 271/263 X |
| 3,993,303 | 11/1976 | Riedl et al. | 271/263 |
| 4,121,818 | 10/1978 | Riley et al. | 270/52.29 |
| 4,462,585 | 7/1984 | Gieson et al. | 271/263 X |
| 4,531,726 | 7/1985 | Bornstein | 271/263 |
| 4,634,107 | 1/1987 | Vandersyde et al. | 271/85 X |
| 4,649,691 | 3/1987 | Buckholz | 53/53 |
| 4,697,246 | 9/1987 | Zemke et al. | 271/263 X |
| 4,728,097 | 3/1988 | Vandersyde et al. | 271/263 X |
| 4,936,562 | 6/1990 | Rowe | 270/58.03 X |
| 5,125,642 | 6/1992 | Orsinger et al. | 271/262 |
| 5,220,770 | 6/1993 | Szewczyk et al. | 53/493 |
| 5,303,912 | 4/1994 | Blank et al. | 271/263 |
| 5,348,286 | 9/1994 | Buck | 271/263 |

*Primary Examiner*—Hoang Nguyen
*Attorney, Agent, or Firm*—Lothrop & West

[57] ABSTRACT

An apparatus and method for singulating sheets from a stack of sheets and transporting individual ones of them to a conveyor. A picker arm is mounted at its upper end to a rotatable shaft, for reciprocating movement between first and second positions. A lower end of the arm includes a foot and a movable gripper jaw. When the arm is rotated into the first position, it grasps a segregated sheet. As the arm reverses direction and rotates toward the second position, it draws the sheet away from the stack. A sensor, provided within the foot, produces an electrical signal corresponding to the thickness of the sheet. The digital output signal is compared to a reference, or calibration value stored in a computer. If the output signal falls unacceptably outside the reference value, a signal is stored to effect later outsorting. Just before the arm reaches the second position, the jaw is opened, dropping the sheet upon the conveyor. The conveyor is successively indexed to other picking arm stations, collating sheets for subsequent insertion into an envelope. The computer effects a downstream outsort of any envelopes containing a defective load.

21 Claims, 11 Drawing Sheets

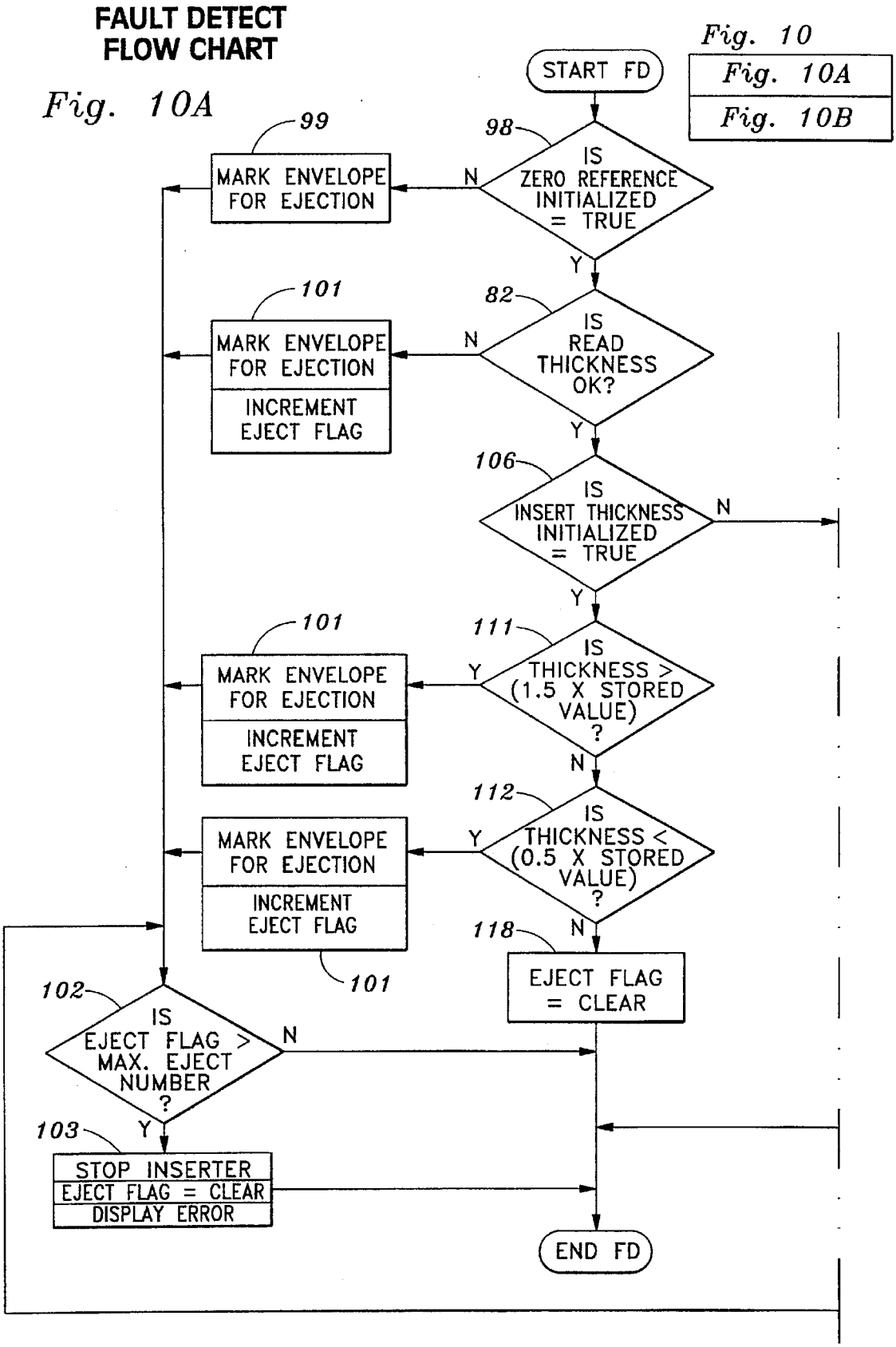
FAULT DETECT FLOW CHART
Fig. 10A
Fig. 10
Fig. 10A
Fig. 10B
START FD
98
IS ZERO REFERENCE INITIALIZED = TRUE
N
Y
99
MARK ENVELOPE FOR EJECTION
82
IS READ THICKNESS OK?
N
Y
101
MARK ENVELOPE FOR EJECTION
INCREMENT EJECT FLAG
106
IS INSERT THICKNESS INITIALIZED = TRUE
N
Y
111
IS THICKNESS > (1.5 X STORED VALUE) ?
Y
N
101
MARK ENVELOPE FOR EJECTION
INCREMENT EJECT FLAG
112
IS THICKNESS < (0.5 X STORED VALUE) ?
Y
N
MARK ENVELOPE FOR EJECTION
INCREMENT EJECT FLAG
101
118
EJECT FLAG = CLEAR
102
IS EJECT FLAG > MAX. EJECT NUMBER ?
N
Y
103
STOP INSERTER
EJECT FLAG = CLEAR
DISPLAY ERROR
END FD

APPARATUS AND METHOD FOR SINGULATING SHEETS AND INSERTING SAME INTO ENVELOPES

FIELD OF THE INVENTION

The invention generally relates to devices for singulating sheets or inserts of film or paper material from a stack, and transporting individual ones of them to a collation conveyor, for subsequent insertion into envelopes. More specifically, the invention pertains to improvements in a machine known as a "Phillipsburg-type" mail inserter. These machines have applications, for example, in filling mail envelopes with multiple sheets of advertisements, flyers, announcements, or the like.

BACKGROUND OF THE INVENTION

The most common and widely used high speed mail inserters are of the "Phillipsburg-type", having initially been introduced in the late 1920's. U.S. Pat. No. 2,325,455 discloses such a mail insertion device. In normal operation of these inserters, a suction cup rotates into engagement with a lowermost sheet, in a stack of film or paper. The cup then rotates away from the stack, drawing with it a single, segregated sheet. A reciprocating picker arm, provided with a pivotally mounted gripper jaw on its lower end, rotates into a first position, adjacent an edge of the segregated sheet. The gripper jaw then rotates into a closed position, seizing the single sheet of film. With the film in its grasp, the picker arm next rotates into a second position, where the jaw rotates open and the sheet is deposited upon a conveyor. The picking cycle is repeated, successively delivering individual sheets in a continuous fashion.

A typical mail inserter will have a plurality of such picker arm stations, arranged in a row overlying the conveyor. Each picker arm, and the associated sheet segregating components, is dedicated to a particular stack of sheets or film inserts. The conveyor is successively indexed beneath each picker arm, for collating the proper number and types of sheets. After the sheets are properly assembled, they are inserted into envelopes for mailing.

Two persistent and recurrent fault conditions occur in everyday use of this prior art, "Phillipsburg-type" machine. In the mail inserter industry, these fault conditions are respectively termed "doubles" and "misses". For example, if the suction cup concurrently draws two or more sheets away from the same stack, a "double" will occur unless this fault condition is detected and corrected. Likewise, if the suction cup fails to pull down a sheet from the stack during a picking cycle, a "miss" will occur, unless detected and corrected.

To detect these fault conditions, the prior art device includes a dual contact switch on the picker arm. A movable arm of the switch is attached to the same drive shaft which pivots the gripper jaw open and closed. Accordingly, with the jaw closed, the position of the switch arm is determined by the thickness of the sheet, if any, holding the jaw partially open. In this manner, a "double" deflects the switch arm into one extreme position against one contact, and a "miss" deflects the switch arm into an opposite extreme position against the other contact. Manually actuated adjustment screws are provided for both switch contacts, so that each will make contact with the arm at predetermined positions corresponding to a fault condition.

In the event of either fault condition arising, a signal is sent to a main control relay, immediately and completely shutting down the entire machine, until the condition is corrected.

Over a period of time, the pivot shaft for the gripping jaw and their associated bearings become worn. This wear causes the prior art system to read faults conditions erratically, and makes the switch contacts difficult to set properly. The switch contact points also become oxidized and highly resistive, making electrical contact erratically or not at all. Machine operators often forget to readjust the "double" detect switch contact when sheets or inserts of different thicknesses are loaded into the machine. This maladjustment, for example, allows a "double" of thinner inserts mistakenly to be detected as acceptable in thickness. All of these problems lead to unnecessary stops and undermine the production efficiency of the inserter.

Over the years, some efforts have been made to modernize these intensely mechanical mail insertion devices, which have numerous cams, chains, gears, drive shafts, bearings, and electro-mechanical switches. For example, in U.S. Pat. No. 4,634,107, a gripper jaw including an electrical solenoid for actuating the movable jaw member, is disclosed. The '107 Patent also shows a pair of magnets mounted to the movable jaw member and a Hall Effect sensor on the picker arm. The sensor produces a signal proportional to jaw displacement. However, since the bearings supporting the movable jaw and the magnets are subject to wear over a period of time, this arrangement may also lead to unreliable and inefficient operation.

By eliminating and redesigning many of the mechanical and the electro-mechanical components of the prior art devices, the invention described herein enjoys improved reliability in operation and higher "throughput" in pieces handled. The invention includes an improved sensor system for the gripper jaw which is highly accurate and not susceptible to wear-induced inaccuracies or unreliability. Certain cams, shafts, and gears of the prior art machine are replaced with pneumatic drivers, controlled by a computer and programmable software. The present invention also provides new operational features in mail inserter machines, with its computer gathering, storing and processing current information about the operating parameters of each gripper jaw assembly. The computer software disclosed herein further makes logic decisions and issues control signals, which, for example, outsort envelopes containing defective insert packages.

SUMMARY OF THE INVENTION

The present invention includes a combined picker arm and gripper jaw assembly. A stationary foot extends in perpendicular fashion from the lower end of the picker arm. The gripper jaw, pivotally mounted to the lower end of the picker arm works in conjunction with the foot to grasp inserts or other sheet material. The picker arm and the foot are manufactured from non-magnetic material, whereas the gripper jaw is manufactured either from steel, or another ferro-magnetic material.

A Hall-effect sensor, or an equivalent sensing device, is positioned within the foot, immediately beneath the area where a bite portion of the movable jaw comes into contact with the foot. A small, but powerful permanent magnet is also located within the foot, underneath the sensor. The magnet produces a magnetic field, with flux lines passing normal to a planar surface of the Hall-effect sensor.

With the gripper jaw in a remote, open position, the flux lines are unfocused, and substantially unaffected by the presence of the jaw. As the gripper jaw is moved closer to the sensor, the steel jaw focuses, or intensifies, the lines of flux, producing an output from the sensor which is proportional in magnitude to the distance between the jaw and the sensor. The analog output signal of the sensor is converted into a digital signal by an A/D converter, also located within the foot. The digital signal is then fed to an input/output port of a computer, which monitors, stores, and processes the sensor data.

The invention also includes a software driven control system. The control system is used in conjunction with a plurality of the picker arm and gripper jaw assemblies described above, and other associated components of a mail inserting machine. One feature of the control system is its ability automatically to calibrate, or "set up" the inserting machine, at the beginning of a job, using the particular sheets or inserts of interest for that job. Initially, then, the control system selectively samples data outputs of each sensor during a calibration sequence, for purposes of storing reference calibration standards.

One standard, for example, is termed to a "zero" calibration reference, corresponding to a completely closed position for the gripper jaw. Another standard corresponds to an average, or normalized thickness for a single sheet or insert to be grasped by the gripper jaw and foot. By comparing ongoing data samples to the reference standards, the computer can determine whether or not a particular sheet is within an acceptable tolerance range, centered on the normal thickness standard. If it is not, the computer can provide, among other things, visual information to the operator as to the nature and location of the anomaly.

When the machine is placed into operation, ongoing data samples are taken from each sensor, and compared to those reference calibration standards. In the event of a fault condition, such as a "double" or a "miss", the control system allows the mail inserting machine to continue running while it electronically "marks" the defective insert package. When the insert packages are inserted into envelopes downstream from the pickers, the inserting mechanism receives a control signal from the computer, not to seal the envelope containing the defective insert package. The defective insert package is subsequently out-sorted into a reject collection bin. Envelopes containing normal insert packages are sealed and transported to a mail collection bin.

BRIEF DESCRIPTION OF THE DRAWINGS

FIGS. 10A and 10B, together, are a flow chart of the fault detect process and system; and, FIG. 11 is a schematic diagram of the sensor system and the computer input/output port of the present apparatus.

DETAILED DESCRIPTION OF THE PREFERRED EMBODIMENT

Figure 1:
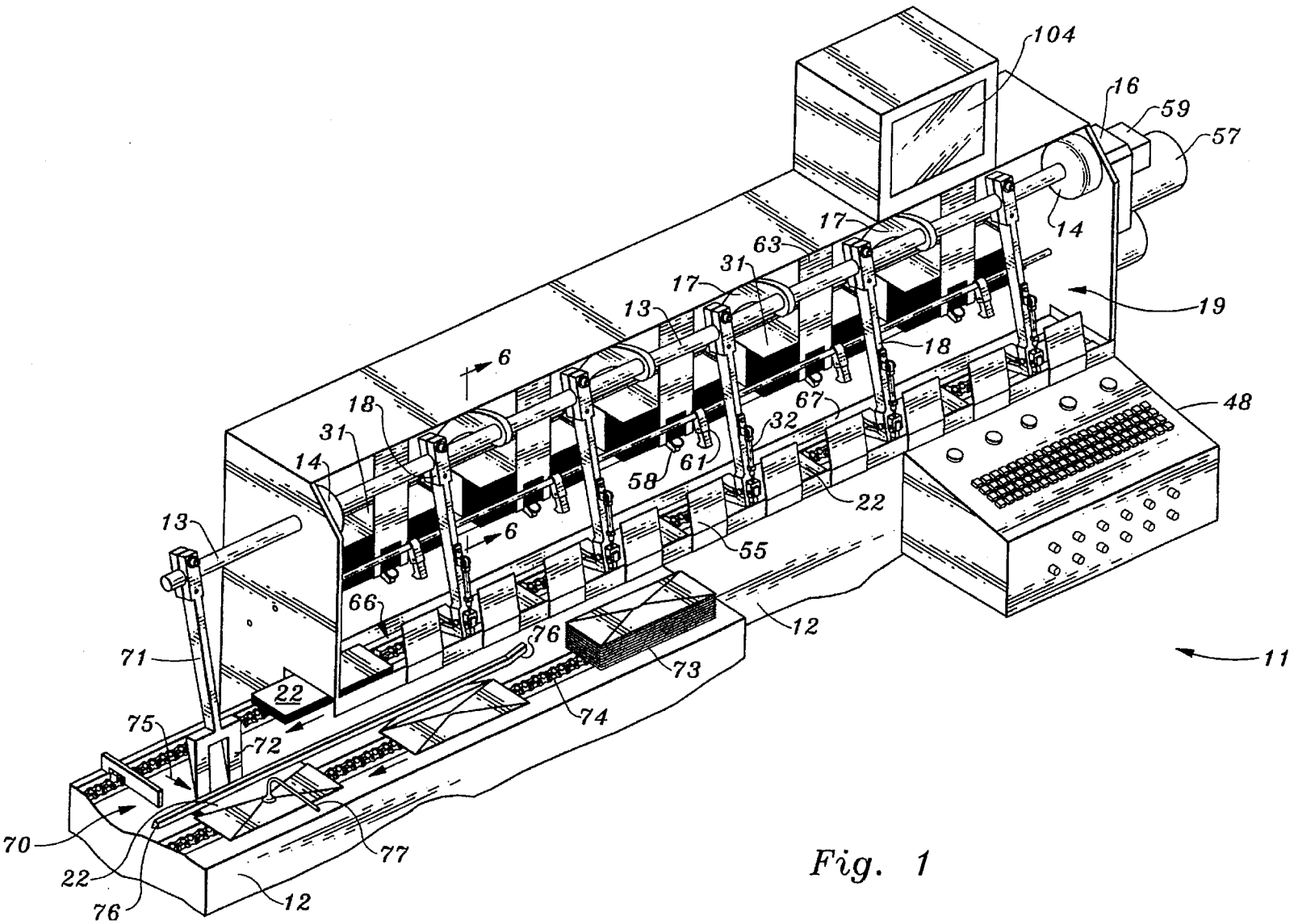
FIG. 1 is a left front perspective of a mail inserting apparatus embodying the present invention.
Figure 2:
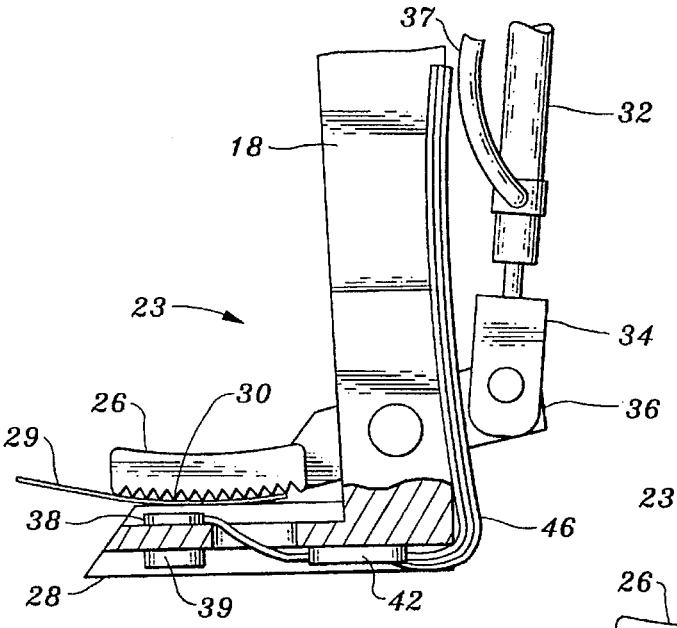
FIG. 2 is a side elevational view of a picker arm and a gripper jaw assembly grasping a single sheet from bottom of a stack, a portion of the lower end of the foot and gripper jaw being broken away to show inner components and structural details.
Figure 3:
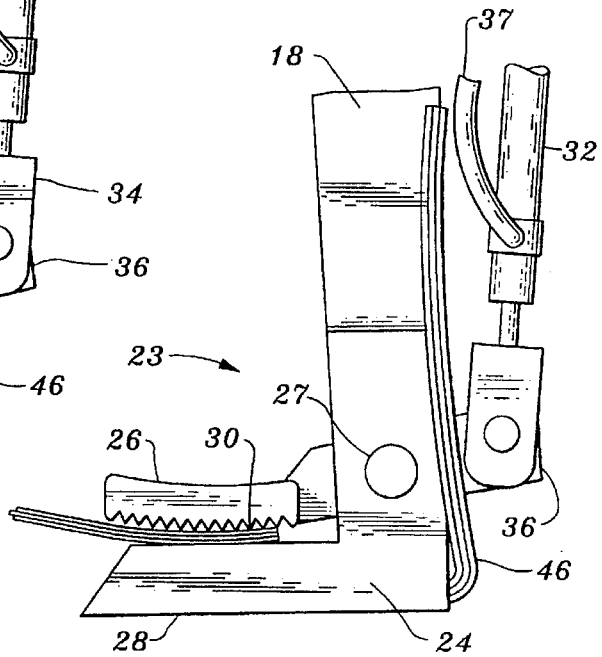
FIG. 3 is a side elevational view similar to FIG. 2, but showing a "double" fault condition, with a plurality of sheets being grasped by the gripping jaw.

Turning now to the drawings, FIG. 1 shows a mail inserter machine 11, made in accordance with the teachings of the present invention. Inserter 11 includes a frame 12 upon which the majority of the components to be described herein are mounted. A rotatable drive shaft 13 extends across the upper portion of frame 12, supported at each respective end by a bearing 14. Shaft 13 is driven by a 5:1 gear reduction box 16, and an associated crank mechanism (not shown). For additional support, shaft 13 is also journaled through a plurality of angled arms 17, extending upwardly from frame 12.

The inserter includes a plurality of picker arms 18, each having an upper end 21 attached to shaft 13. The arms 18 are arranged in spaced relation along shaft 13, at respective picking stations 19. The number of picking stations is not critical to the invention, and is dictated by the number and kind of separate inserts which are to be collated into an insert package 22. Typically four to six picking stations are employed in mail inserter machines.

A gripper jaw assembly 23 is provided at a lower end 24 of the picker arm 18. Assembly 23 includes a movable gripper jaw 26, pivotally attached to arm 18 by means of a shaft 27. Gripper jaw 26 includes a bite portion 30, having ridges and grooves. Gripper jaw 26 is manufactured either from steel, or another ferro-magnetic material. Assembly 23 also includes a stationary foot 28, extending in perpendicular fashion from the lower end 24 of arm 18. Both foot 28 and arm 18 are manufactured from a non-magnetic material, such as aluminum. Jaw 26 and foot 28 cooperate to grasp an individual sheet, or insert 29 of film or paper material from a stack 31, in a manner to be described more fully below.

To actuate jaw 26 from a remote, open position to a proximate, closed position (see, FIGS. 2–5), a pneumatically driven cylinder 32 is provided. An upper end of cylinder 32 is pivotally attached to a bracket 33 on arm 18. A lower end of cylinder 32 includes a clevis 34, pivotally attached to a lever arm 36 of gripper jaw 26. Cylinder 32 is driven in reciprocating fashion by alternating pneumatic pressure provided by lines 37. A source of pressurized air and associated valves (not shown) actuate cylinder 32 and move jaw 26, in synchronism with the rotational position of picker arm 18, as discussed herein.

One of the important features of the present invention, is the sensor system for accurately determining and measuring, the position of jaw 26 relative to the adjacent surface of foot 28. Applicants herein use a linear Hall-effect sensor 38, having the recognized characteristic of producing an output voltage proportional to the intensity of the magnetic field perpendicular to it. Other equivalent sensors may be used as well, such as those operating on inductive, capacitive, magneto-resistive, or optical principles.

Figure 4:
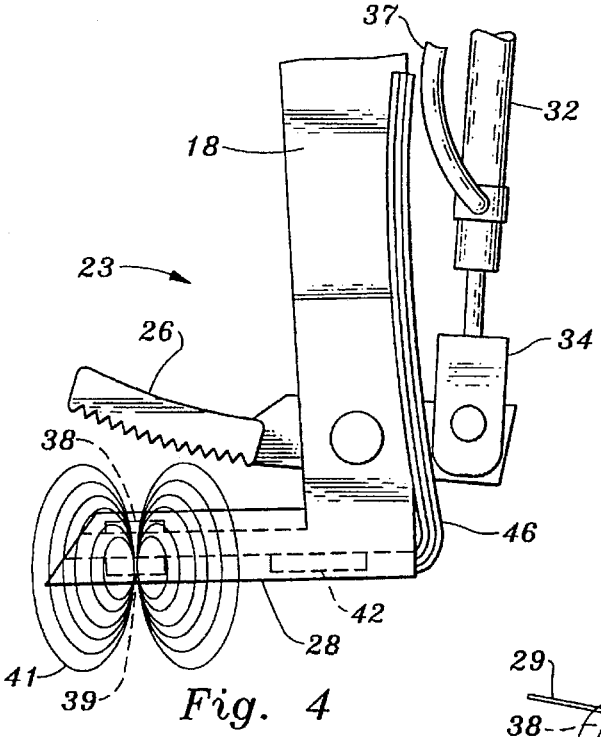
FIG. 4 is a fragmentary representation of the gripper jaw assembly and the thickness measuring components, showing the magnetic flux lines with the gripper jaw in an open position.
Figure 5:
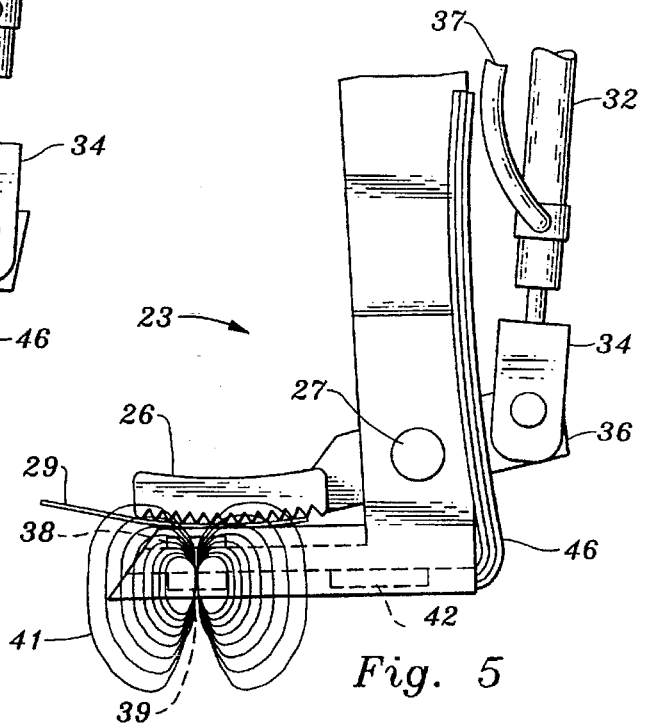
FIG. 5 is a view as in FIG. 4, but showing the magnetic flux lines with the gripper jaw in a closed position.

Immediately beneath sensor 38 is a disc-shaped permanent magnet 39. As shown in FIG. 4, magnetic flux lines 41 pass between the poles of the magnet. At least some of the flux lines also pass generally in perpendicular fashion, through Hall-effect sensor 38. With the gripper jaw 26 in its open position, flux lines 41 are largely unaffected, or otherwise distorted from the normal doughnut-shaped flux pattern produced by the magnet. However, when the jaw is lowered toward a closed position, in proximate relation to foot 28, the pattern is distorted, as shown in FIG. 5. The increased physical proximity of the steel jaw intensifies the magnetic flux lines, causing proportional changes in the output signal from sensor 38.

The important factors for the improved sensor system herein are the location of the sensor 38 and its operative relationship with the gripping jaw 26. By placing the sensor in the foot, the sensor is stationary and in closest proximity to the area where the actual measurement between the jaw and the foot is to be made. The sensor herein is further characterized by detecting the physical location of the jaw without relying upon a field producing element, or the like, on the movable jaw structure. Both of these aspects of the disclosed sensor system cooperate to eliminate inaccurate or erratic readings caused by physical wear of bearings, pivots, and drive shafts in the picking arm and gripper jaw assemblies.

Also located within foot 28 is a 12 bit, analog-to-digital converter 42. By placing the converter 42 in adjacent relation to the sensor 38, deterioration of the signal-to-noise ratio of the sensor's output signal is minimized. In other words, by immediately digitizing the analog output of the sensor, the resultant signal is less susceptible to extraneous noise which might otherwise be induced into the line, producing false or erratic readings.

Figure 11:
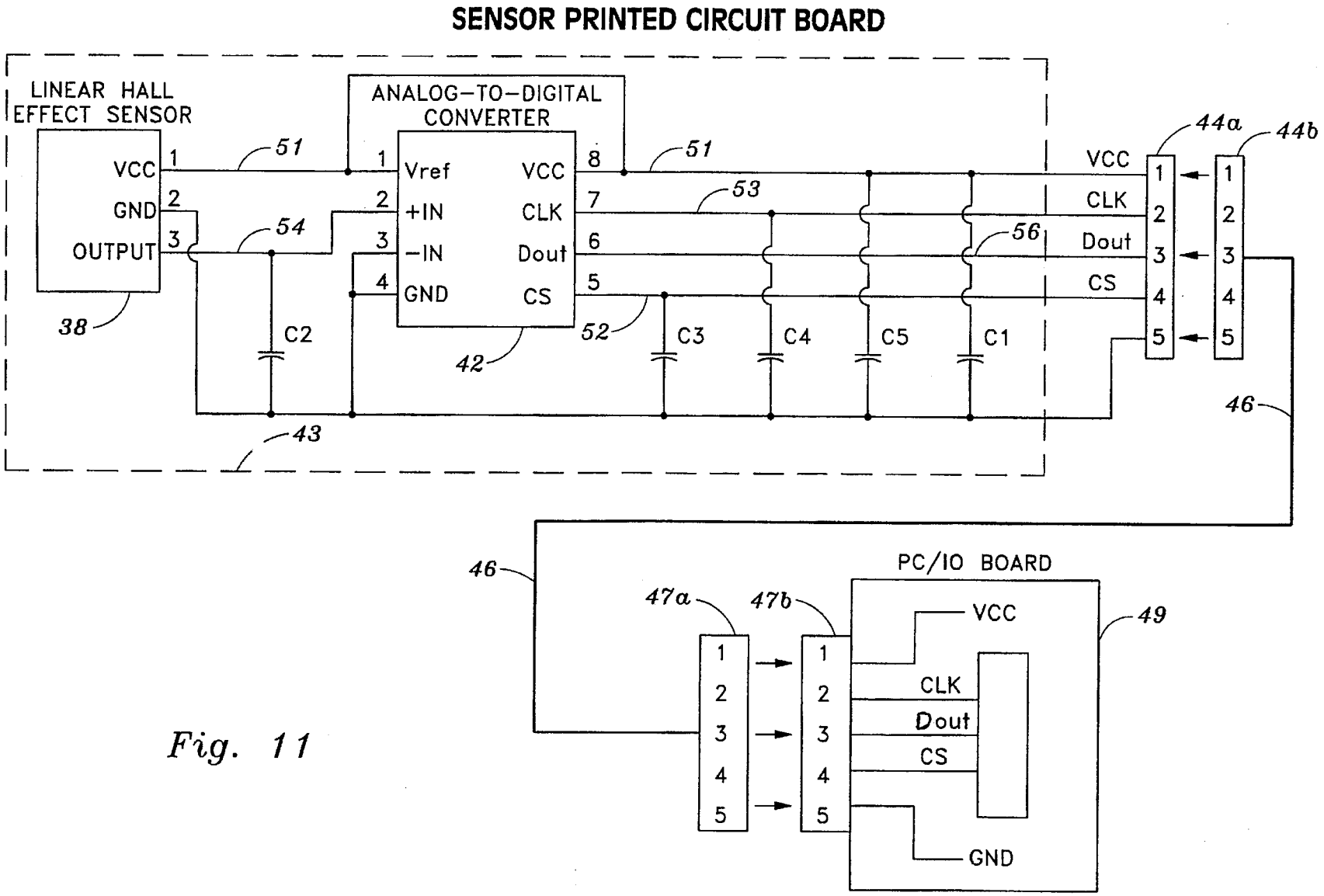

As shown in FIG. 11, sensor 38, converter 42, and filtering capacitors C1–C5 are enclosed within a broken line. This broken line represents a sensor printed circuit board 43, nested within a slot in the underside of foot 28. Wires extending from board 43 terminate in a board connector 44(*a*), adapted to mate with a line connector 44(*b*). A sensor line 46 extends between line connector 44(*b*) and a first computer connector 47(*a*). Lastly, a second computer connector 47(*b*) is provided to receive first computer connector 47(*a*). A computer 48, including an input/output board 49, is thereby interconnected to sensor 38.

Computer 48 provides a supply voltage VCC 51 both to the A/D converter 42 and to the Hall-effect sensor 38. At a predetermined time, the computer sends a "chip-select" signal 52 to the CS input of the converter. Signal 52, in effect, turns on the converter so it is capable of performing the analog-to-digital conversion. Concurrently, the computer sends a clock signal 53 to the CLK input of the converter. The clock signal determines the rate at which the converter samples the output 54 of sensor 38, and performs the analog-to-digital conversion of that sampled output signal. The 12 bit digital converter output 56 is then delivered to the input/output board of the computer 48, over sensor line 46.

Having discussed the gripper jaw assembly and sensor circuitry, we can now turn to the operation of the picker arm 18 in conjunction with these components. A motor 57, shown in FIG. 1, drives gear reduction box 16. Motor 57 is preferably of the three-phase variety, driven by an AC phase inverter/controller of conventional design. The inverter/controller, responsive to commands from the computer 48, produces an AC voltage of variable frequency. This output voltage drives motor 57 at adjustable, predetermined speeds, depending upon the computer command.

The output of gear box 16 is connected to a crank mechanism (not shown), which converts the continuous rotary motion to a reciprocating rotary motion. Shaft 13, connected to the output of the crank mechanism, is thereby driven in reciprocating, cyclical fashion from a first rotational position (FIG. 6D), to a second rotational position (FIG. 6H), and then back again. An optical encoder 59, mounted on gear box 16, provides information to the computer 48 at all times, regarding the precise rotational position and direction of movement of the shaft and the array of picker arms 18 attached thereto.

Figure 6B:
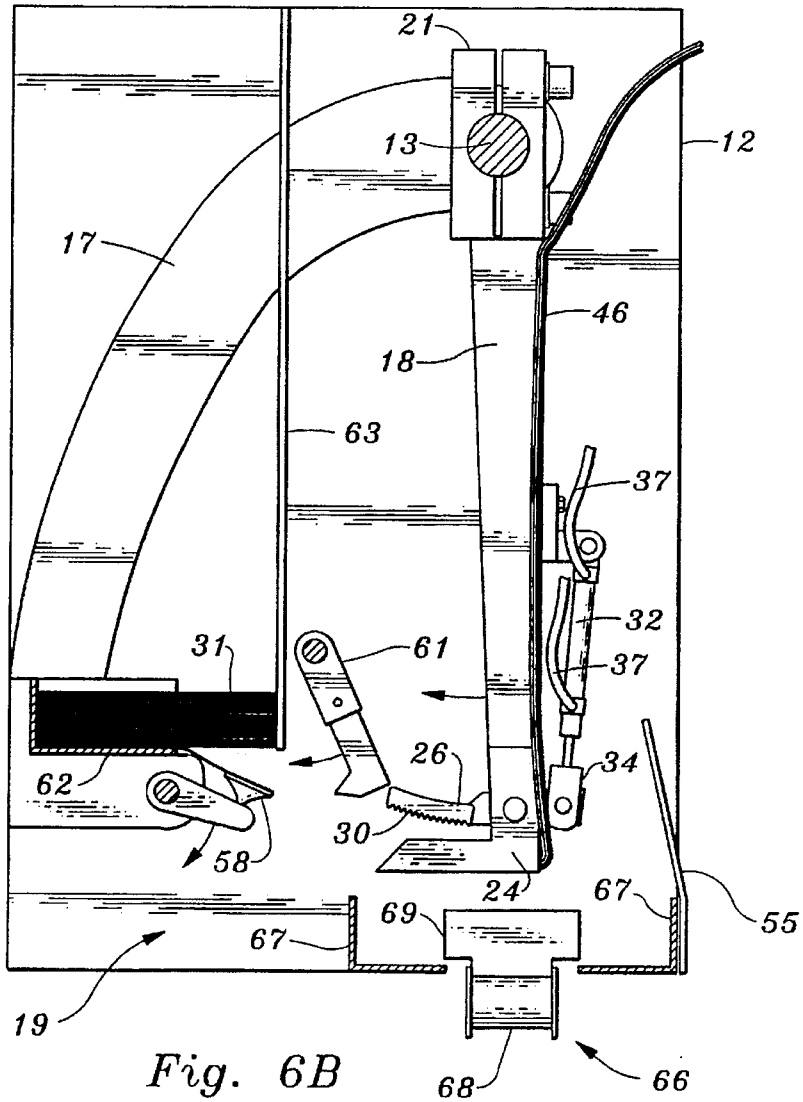
FIGS. 6A through 6H are side elevational views taken on the line 6—6 in FIG. 1, showing the picker arm, a stack of inserts, the vacuum cup, and the insert separator in a series of positions, as the picker arm reciprocates through an entire cycle.
Figure 6A:
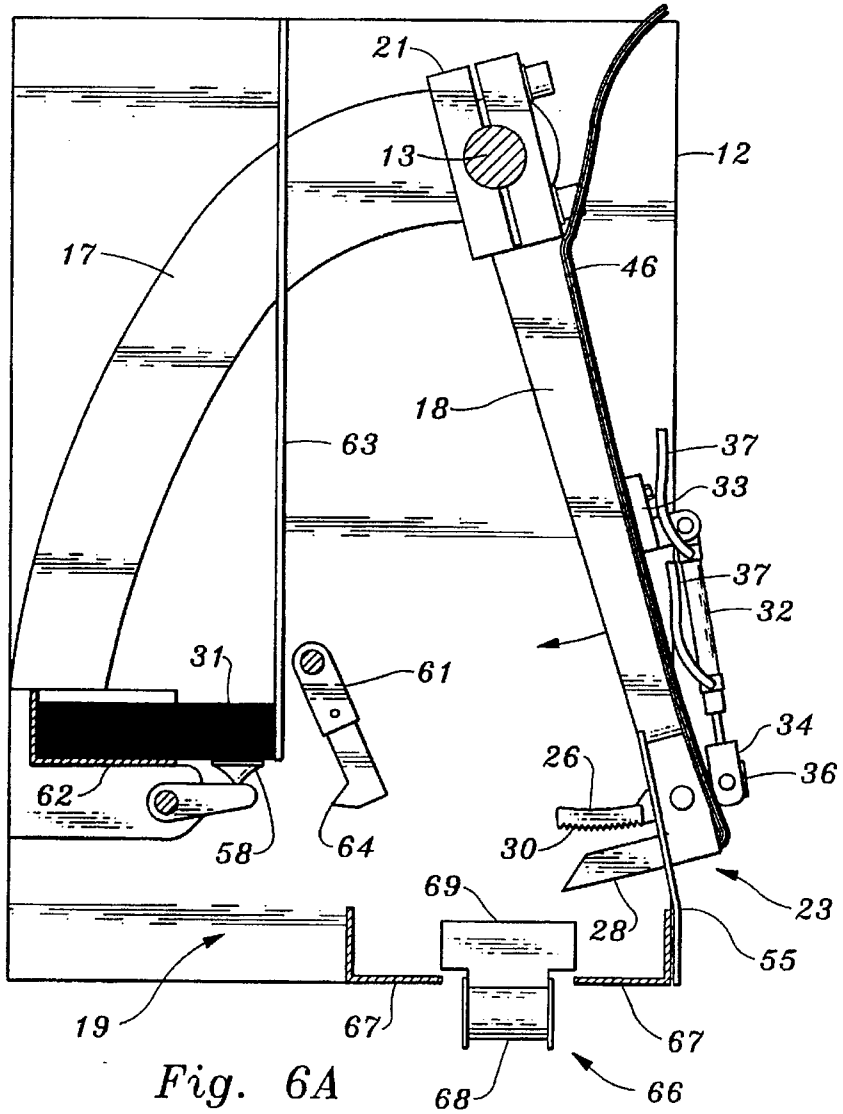

FIG. 6A shows the respective positions of the components of a picking station 19, just after the initiation of a new sheet picking cycle. The gripper jaw 26 is in a fully open position, and a vacuum cup 58 is rotated into a fully horizontal position, in flush engagement with a lowermost sheet 29 in stack 31. A sheet separator arm 61 is maintained in an extreme counterclockwise position. As the picker arm progresses toward the stack 31, vacuum cup 58 rotates clockwise to segregate, or singulate the lowermost sheet 29 from the stack (see, FIG. 6B). The remainder of the stack 31 is maintained securely in place by shelf 62 and vertical barrier wall 63. As cup 58 continues to withdraw the sheet 29, separator arm 61 begins to rotate clockwise, toward the sheet.

Figure 6D:
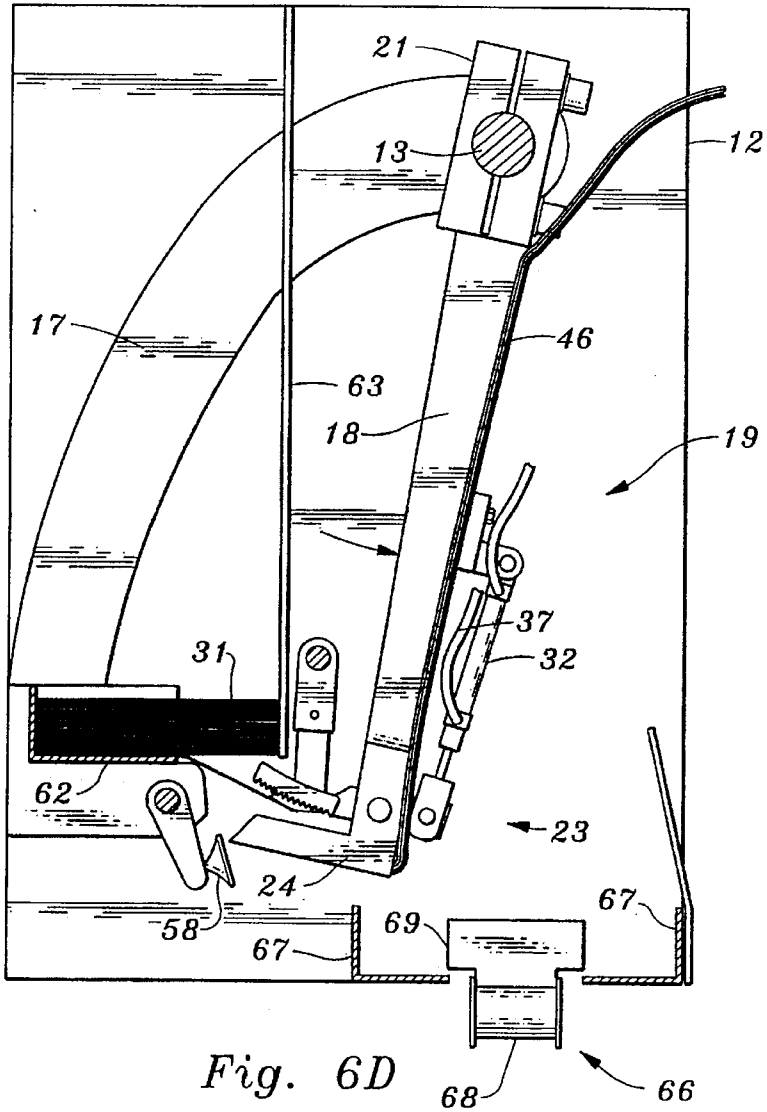
Figure 6C:
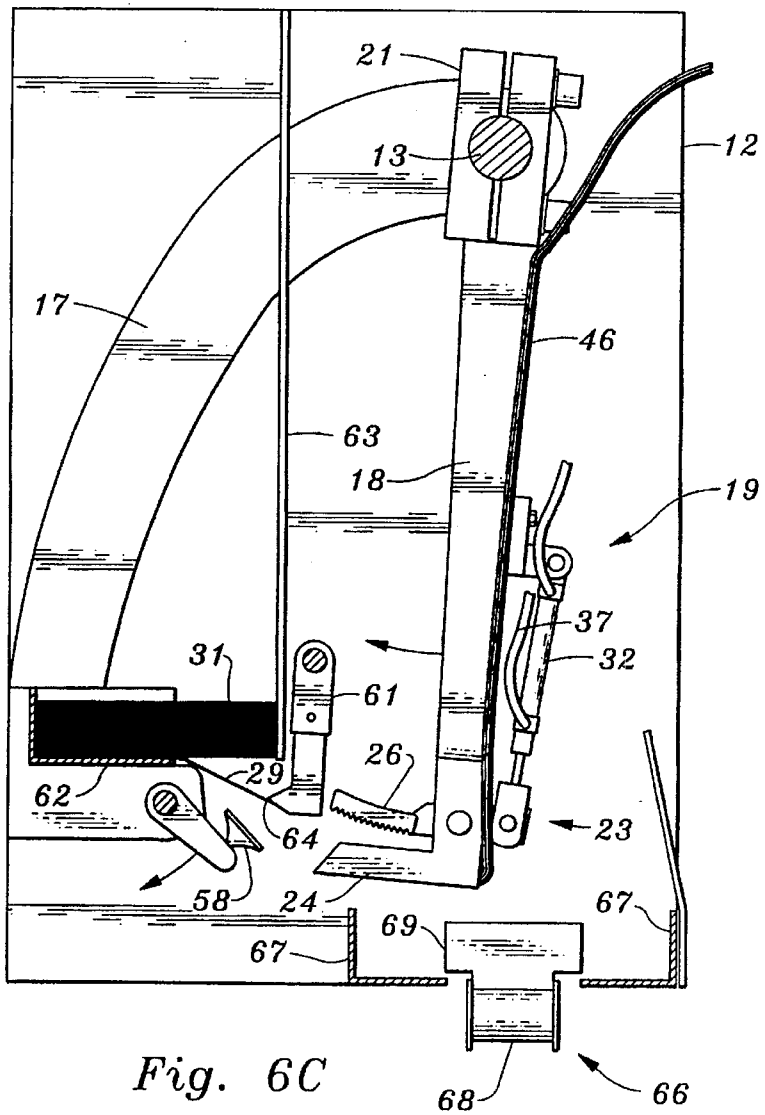

In FIG. 6C, the picker arm continues to approach sheet 29. Separator arm 61 rotates into a position sufficiently clockwise, so its tip 64 overlaps the leading edge of sheet 29. Concurrently, the vacuum previously applied to cup 58 is shut off, and the cup continues to withdraw, in a clockwise direction. The resiliency of the sheet is sufficient to maintain the sheet against the tip 64, in readiness for picking.

Picker arm 18 has reached a first rotational position in FIG. 6D, with the leading end of sheet 29 between gripper jaw 26 and foot 28. Optical encoder 59 confirms this first rotational position, by sending a signal to computer 48. The computer, in turn, sends a control signal to an electronically actuated pneumatic valve (not shown), which passes a pneumatic blast into cylinder 32. With cylinder 32 in a withdrawn position, gripper jaw 26 including bite portion 30 close upon the sheet, holding it fast against foot 28.

The second part of the cycle now begins, as picker arm 18 rotates counterclockwise, pulling individual sheet 29 from the stack. Vacuum cup 58 begins a counterclockwise rotation toward the next lowermost sheet within stack 31. The optical encoder confirms the continually changing rotational position of the arm for the computer 48. At a predetermined position for arm 18, approximately represented by the arm as shown in FIG. 6E, the computer samples the Hall-effect sensor, in the manner described above. The value of this sample corresponds to the distance between jaw 26 and foot 28, and hence, the thickness of sheet 29.

Figure 6F:
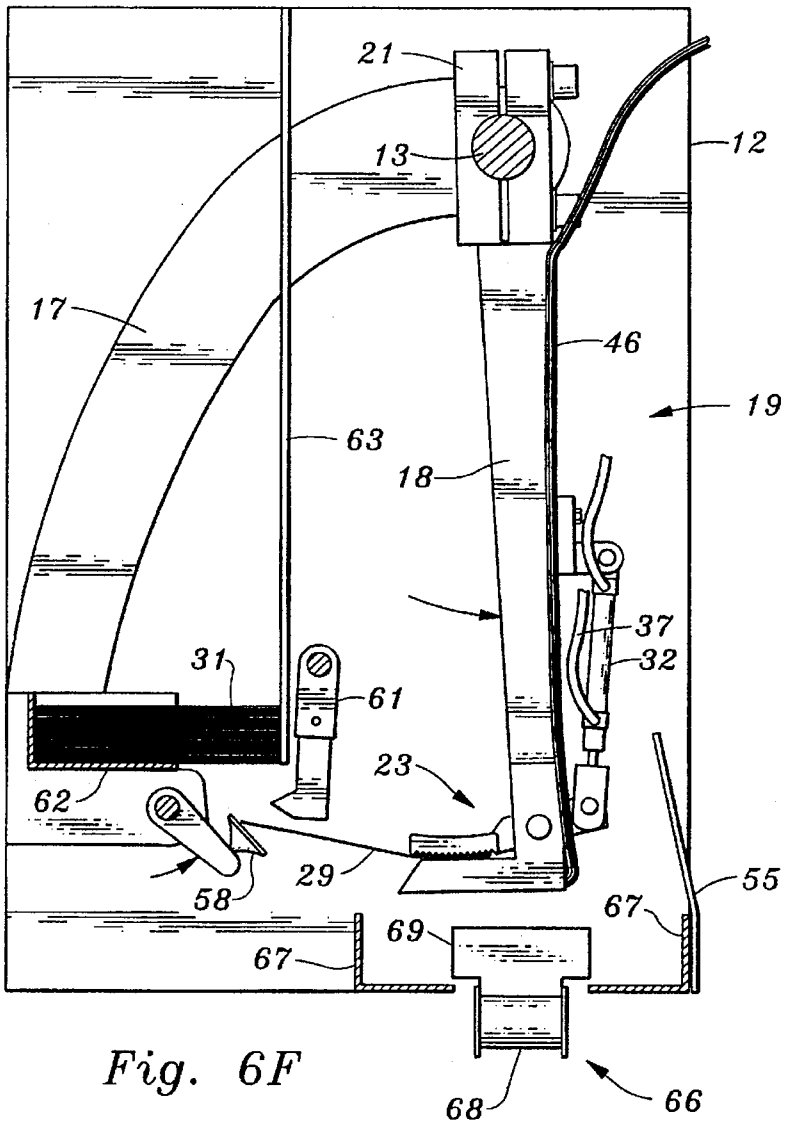
Figure 6E:
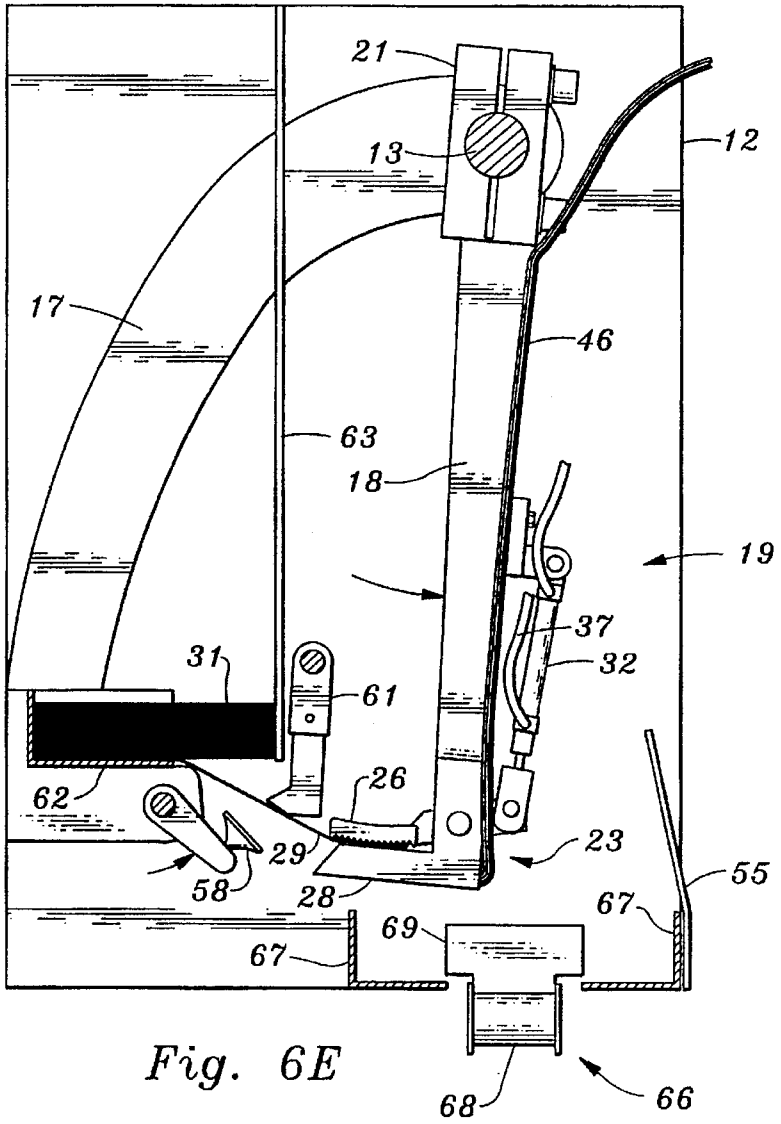

FIG. 6F depicts the continued progression of picker arm 18, toward a second rotational position. Sheet 29 is now entirely free from the stack 31. By the time picker arm has reached the position shown in FIG. 6G, separator arm 61 has withdrawn sufficiently to allow vacuum cup 58 to rotate into engagement with a new lowermost sheet. Having information about the advanced position of arm 18, the computer sends another control signal to the pneumatic valve, and a reverse blast of air causes cylinder 32 to extend. Gripper jaw 26 is thereby opened, releasing sheet 29.

Figure 6H:
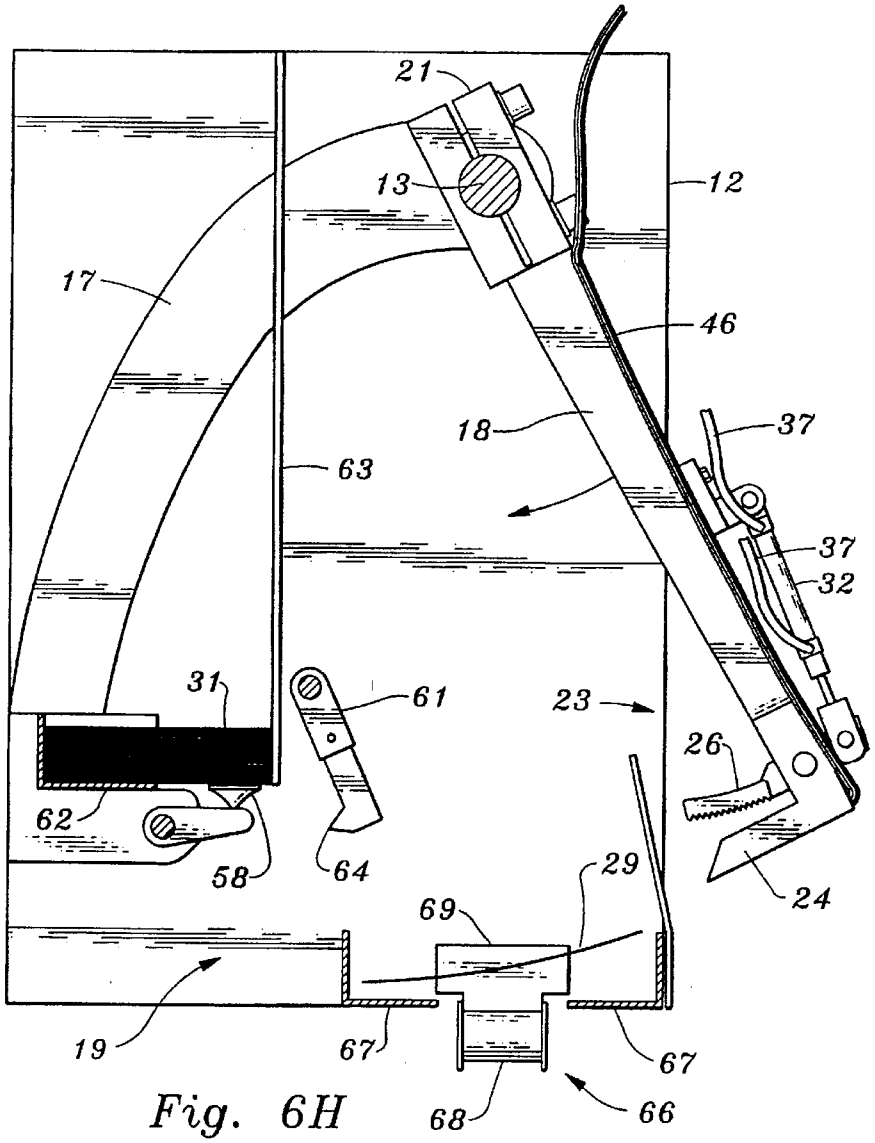
Figure 6G:
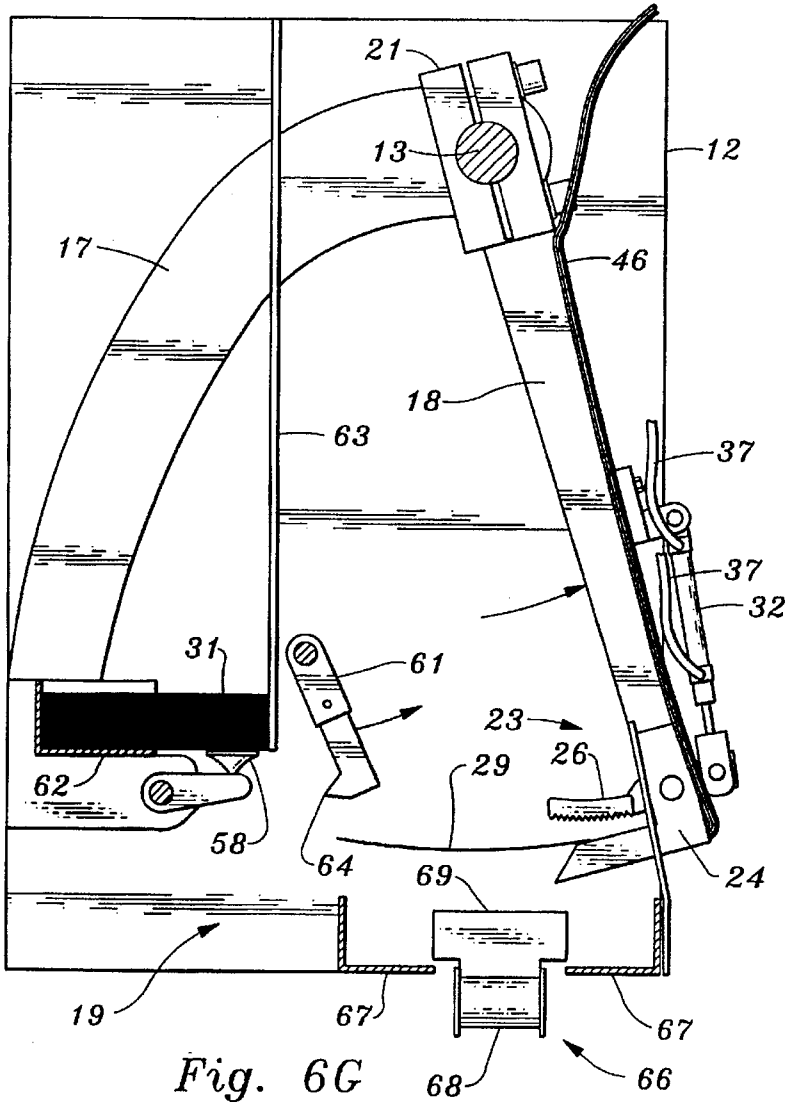

FIG. 6H shows the gripper arm 18 finally advanced to a second, rotational position. At this point, the sheet 29 is now completely free from the arm, and dropping downwardly. Having completed the task of singulating a sheet from the stack, and transporting that sheet to a desired location, arm 18 repeats the same cycle for the successive delivery of additional sheets.

An elongated conveyor 66 passes underneath each of the picking stations 19. The conveyor receives sheets 29 which have been singulated from the stack, transported by rotation of the picker arm, and released. Angled plate 55 is provided as an additional measure, to ensure that an occasional misguided sheet will not be lost. Conveyor 66 includes lateral guides 67, drive chain 68, and push fingers 69. The vertical portions of the guides act laterally to restrain the sheets, while the horizontal portions support the sheets. Drive chain 68 is indexed, or actuated in intermittent fashion, causing fingers 69 to advance accordingly. In this manner, the conveyor stops at each picking station for the addition of another sheet or insert. Sheets are thereby collated into insert packages 22, having the desired number and kind of sheets or inserts.

Complete insert packages 22 are transported on the conveyor 66, from the last picking station to an insertion station 70. A pusher fork 71 at station 70 has an upper end attached to shaft 13, and a pair of lower prongs 72 adjacent a longitudinal edge of an insert package 22. Fork 71 reciprocates in synchronism with picker arms 18, to translate package 22 in the direction indicated by arrow 75.

A stack of envelopes 73 is provided at one end of an envelope conveyor 74. Vacuum cups (not shown) are used both to singulate an individual envelope from the bottom of the stack, and to pull back the envelope flap. As the envelope is moved by conveyor 74, the envelope flap encounters a restraining, or hold-down bar 76. Thereafter, bar 76 maintains the envelope flap in an open position as shown in FIG. 1. Upon reaching vacuum cup 77, further movement of the envelope is arrested. Cup 77 engages an adjacent envelope panel and rotates slightly upwardly, pulling the label panels apart. Pusher fork 71 transfers insert package 22 into the envelope, before cup 77 releases the panel.

Envelopes loaded with a proper insert package are thereafter transported downstream, where the flaps are sealed against the label panel using conventional means well known to those in the industry. However, in the event a defective insert package has been inserted, the envelope is left unsealed and outsorted into a reject collection bin. We will now turn to a discussion of the logic and control system software which works in conjunction with the computer and the sensor system described above to effect detection and outsorting of defective insert packages.

Figure 7:
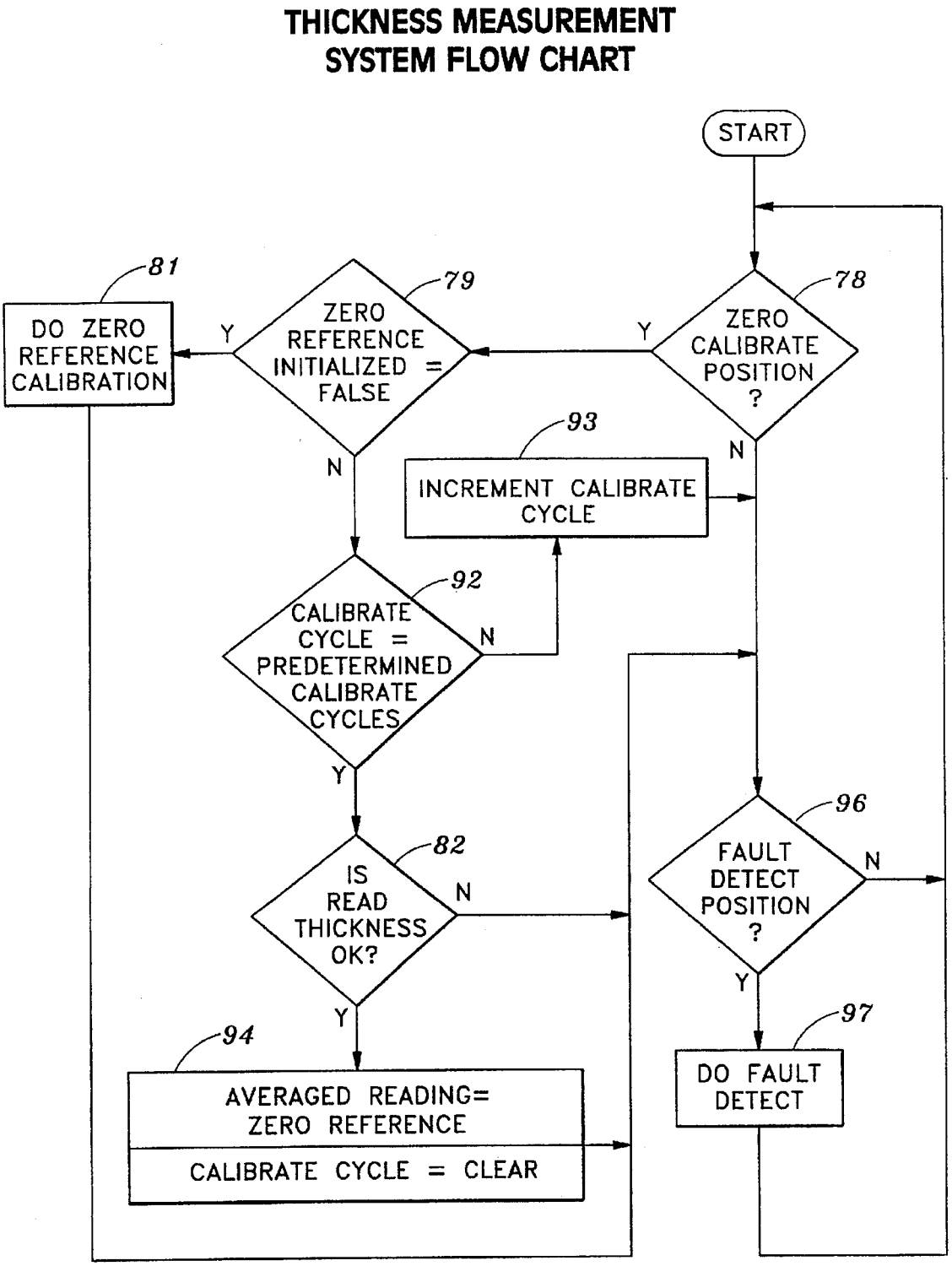
FIG. 7 is a general flow chart of the thickness measurement process and system.

FIG. 7 shows a flow chart for the thickness measurement system of the present invention. Assuming that the mail inserter machine 11 has just been turned on, a calibrate command is entered into the computer and a determination (78) regarding the zero calibrate position of the picker arm is made. In the preferred embodiment, Applicants have designated the portion of the picking cycle when the picker arm is rotating from the second position to the first position, for the zero reference calibration process to occur. This position may be, for example, the position of arm 18, shown in FIG. 6B. This calibration, or initialization process, determines and stores a nominal value for the output of the sensor 38, when the jaw is in a fully closed position, with nothing between the bite portion 30 of the jaw 26, and the foot 28. By storing this value as a zero reference, the computer can subtract this reference from a subsequent sensor reading to obtain a value corresponding to the thickness of a picked sheet.

If the arm is in the proper position, a determination (79) is made whether the zero reference has already been initialized, or not. If it has not, then the computer initiates a zero reference calibration operation (81). As a first step, the computer sends a command signal to an electronic pneumatic controller (not shown). The controller sends a blast of air through lines 37 to retract each of the cylinders 32. This will momentarily close each of the jaws 26 for the duration of the calibration process.

Figure 8:
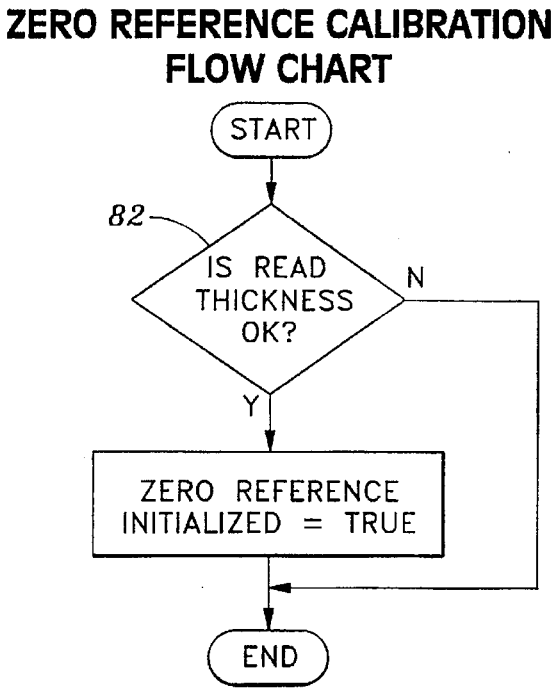
FIG. 8 is a flow chart of the zero reference calibration process and system.
Figure 9:
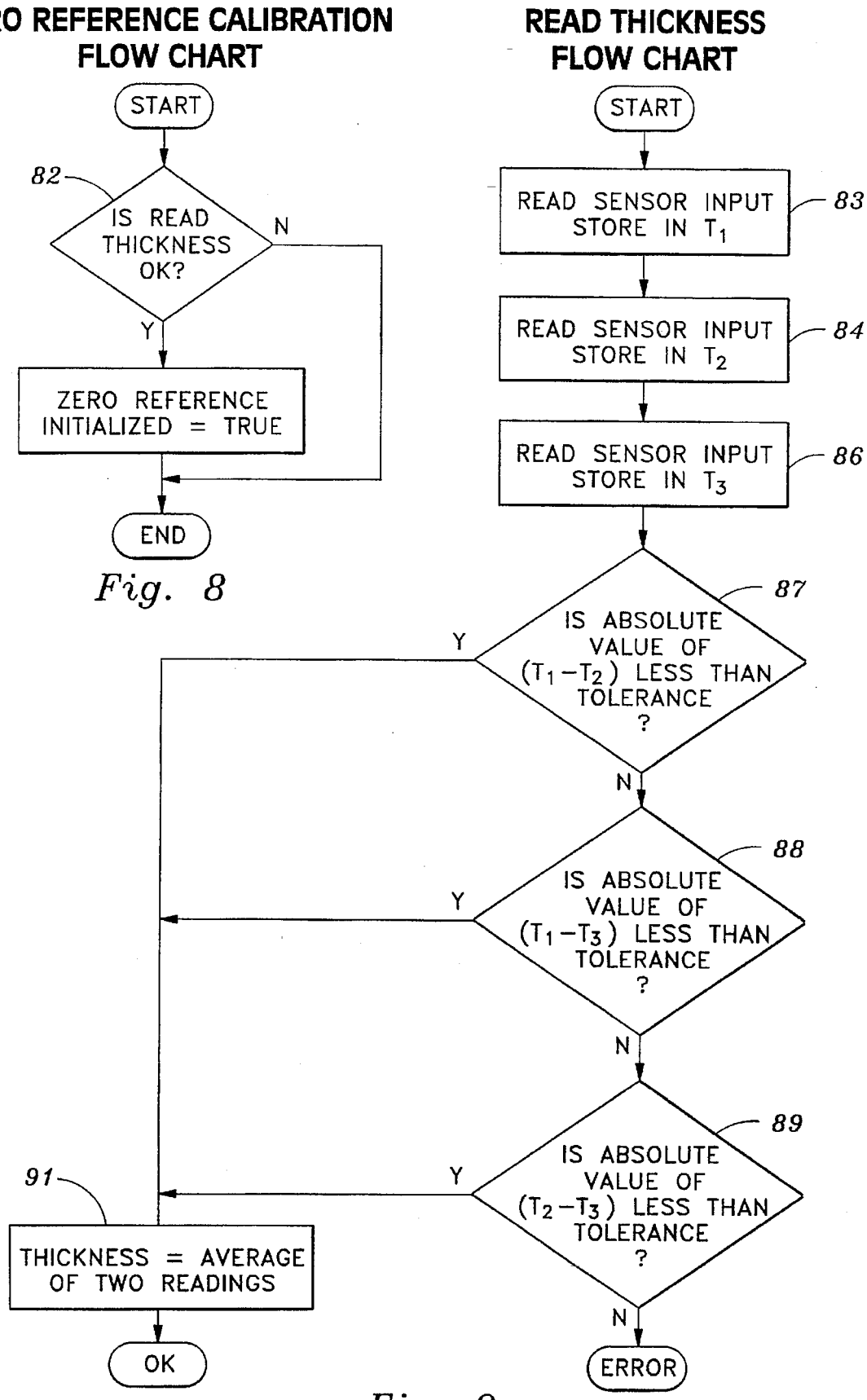
FIG. 9 is a flow chart of the read thickness process and system.

Making reference now to FIG. 8, an initial determination is made whether the read "thickness" is within acceptable tolerances. FIG. 9 shows the sensor sampling method used to make all thickness readings, for initialization procedures and during operation of the inserter 11.

The computer reads the sensor input by issuing a chip select pulse and a series of clock pulses to the A/D converter. The sensor is sampled, and a twelve bit digitized "thickness" value is sent to the computer and stored as T1 (83). Two more samples are read and stored as T2 (84) and as T3 (86). A determination (87) is then made whether the absolute value of the difference between T1 and T2 is less than a predetermined tolerance value. If it is, the value is retained for one of the two values to be used for averaging. If it is not, the value is ignored. In either case, the process continues to a determination (88), where the absolute value of the difference between T1 and T3 is compared to the predetermined tolerance. As before, if the value is within tolerance, the value is retained for averaging; and, if it is not within tolerance, it is ignored.

If both determinations (87) and (88) result in retained values, a thickness determination (91) is made, by averaging the two values. If only one of the first two determinations results in a value within tolerance, the process continues to a last determination (89). If the absolute value of the difference between T2 and T3 is less than the predetermined tolerance, the value is retained, and the averaging determination (91) is made.

If only one, or none of the determinations (87), (88), and (89) results in a retained value, no averaging is made, an error signal results. Typically, such an error signal will result from a hardware problem, such as a defect in the sensor, the A/D converter, or the circuit interconnections. As will become more apparent herein, this multiple sampling process, coupled with tolerance comparison and averaging, ensures reliability in operation of the inserter and provides the operator with rapid identification of machine malfunctions.

Assuming that an averaged reading has been obtained during the read thickness process, this value is stored as a zero reference, and the initialization is completed. The computer then sends another command signal to the pneumatic controller, to extend the cylinders and open the jaws. This entire initialization process is completed in a fraction of a second, well before the picker arm reaches its first position (FIG. 6D).

It is important to note that this zero reference value is stored as digital information in the computer 48. The passage of time, heat, or changes in component operating specifications will not corrupt this value. Prior art devices, to the extent they may have stored such values, stored them as analog information in capacitance devices. Over a period of time, and further as a consequence of environmental factors, the charge held by a capacitor tends to drift and can result in erroneous determinations.

It should be noted from FIG. 7 that following initialization, the next time a thickness measurement is made, the process returns to determination (78) once again. When the picker arm is determined to be in the proper position, determination (79) now by-passes the zero reference calibration steps, and routes the process to a calibration cycle determination (92). The total number of cycles completed is compared to a predetermined calibration cycle number. Applicants have established this number as twenty-five, although the actual number is not critical. If the total of completed cycles does not equal the predetermined number, increment operation (93) advances the total cycles by one number, and the thickness measurement process continues.

If the current cycle number equals the predetermined number, the process is routed to another read thickness determination (82), discussed above. As illustrated in the steps of FIG. 9, a read thickness determination (82) will result either in an averaged reading or an error signal. If it results in an averaged reading, zero reference update operation (94) stores this reading as a new zero reference value. Concurrently, operation (94) clears the calibration cycle number. In this way, after each successive twenty-five reciprocating cycles of the picker arm, a new zero reference value is read and stored.

In accordance with the explanation given above, the picker arm rotates past the zero calibration position to a first position (see FIG. 6D) where the gripper jaw assembly 23 grasps an individual sheet 29. As the arm reverses direction, moving toward a second position, it reaches a fault detection position. FIG. 6E shows the approximate location of arm 18 when a fault detection determination (96) is made. As indicated in FIG. 7, a fault detect operation (97) is initiated at that time.

Figure 10B:
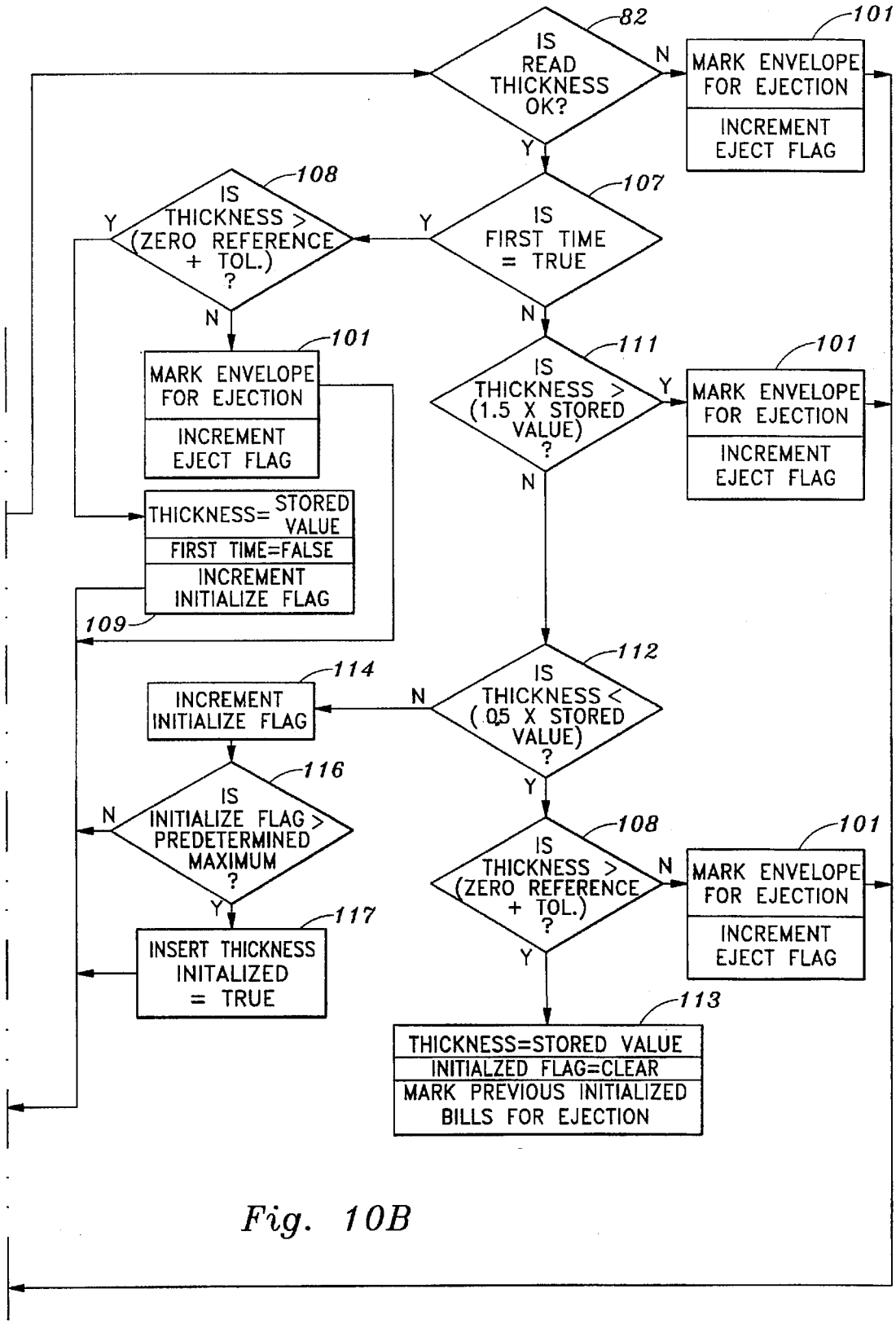

FIGS. 10A and 10B, considered together, illustrate both the initialization and the operational flow chart, for the fault detection system of the present invention. As a first step, a zero reference initialization determination (98) is made. If there has been no such initialization, the resultant insert package 22 and envelope 73 into which the package is loaded will be electronically "marked" for ejection, or outsorting. Mark operation (99) represents this step, as shown in FIG. 10A. The envelope must be marked and outsorted because fault detection cannot be undertaken without having the zero reference value which is used in making thickness and logic determinations.

Next, a read thickness determination (82) is carried out, using the process described above. If the determination (82) produces an error signal, a mark envelope and increment eject flag operation (101) results. Accordingly, the envelope which eventually is loaded with the "marked" insert package, is outsorted from the stream of envelopes containing acceptable insert packages. It is important to note that the present invention accomplishes such outsorting operations while the inserter continues to run. In other words, even though a fault condition has arisen with respect to a particular insert package, the inserter does not shut down unless a predetermined number of fault conditions aggregates. This is to be contrasted to prior art devices, which shut down the entire inserter machine, when a single fault condition arises.

Since the error signal from determination (82) probably indicates a hardware failure, the operation (101) also increments an eject flag. Applicants herein have established a maximum eject flag number of five, for use of the present invention. Although the precise number is not critical, it is selected quickly to stop further operation of the inserter, when a certain number of fault conditions accumulates. Thus, an eject flag determination (102) is made to compare the current total number of eject flags to the predetermined maximum number. If the number is not exceeded, the process continues; however, if it is exceeded, a stop inserter operation (103) is triggered. Concurrent with stopping the inserter, operation (103) clears the accumulated eject flag number, and provides an error symbol for the operator, on the screen of video display 104.

Providing that the read thickness determination (82) is acceptable, a sheet or insert thickness initialization determination (106) is made. When the inserter is first started, or when new sheets or inserts are loaded into the inserter, this determination (106) will automatically begin a thickness initialization procedure, shown in FIG. 10B. This procedure, whether initiated by the operator or by the inserter automatically, starts with a read thickness determination (82). If it results in an error, a mark envelope and increment eject flag operation (101) ensues, as described above.

If the read thickness determination (82) provides an averaged reading, this value is stored. Next, a first time determination (107) is made. Assuming this is the first sheet or insert picked, the process is routed to a thickness comparison determination (108). The averaged thickness reading which was previously stored is compared to the sum of the zero reference and a predetermined tolerance value. Typically, the predetermined tolerance value is selected to accommodate reasonable variances, say five to ten percent, in the thickness of particular sheets or inserts.

If the thickness is less than sum of the zero reference and the tolerance value, the process passes to a mark envelope and increment eject flag operation (101). However, if the thickness is determined to be greater than the sum of the zero reference and the tolerance value, a store thickness value operation (109) is undertaken. This step saves the averaged thickness reading as a first stored value. The operation (109) also recharacterizes the initialization process, as not being a first time sample, when the next sheet or insert is picked. Lastly, operation (109) increments a thickness initialization flag, corresponding to the step of taking a first sample.

This process is repeated with another sheet or insert, to gain further thickness information. This time, however, first time determination (107) results in a negative answer, and the process is routed to a thickness comparison determination (111). The averaged thickness reading for the second sheet is compared to the product of 1.5 times the first stored value. If the averaged thickness is greater, a mark envelope and increment eject flag operation 101 is triggered. If the averaged thickness is less, the process is passed on to another thickness comparison determination (112).

Determination (112) again compares the averaged thickness of the sheet to the product of 0.5 times the first stored value. But this time, if the thickness is less, the process continues to another thickness comparison determination (108). As before, if the thickness is less than the sum of the zero reference and the tolerance value, a mark envelope and increment eject flag operation (101) is initiated. If, however, the thickness is greater than the sum of the zero reference and the tolerance value, the process is passed on to a store thickness value operation (113). This, in effect, replaces the first stored value, as the logic process has determined that the first stored value was incorrect (probably a "double"). In addition, operation (113) clears any existing initialization flags, and marks any sheets previously sampled for initialization purposes for ejection or outsorting.

If determination (112) establishes that the average thickness is greater than the product of 0.5 times the first stored value, the process is directed to an increment initialize flag operation (114). This operation increments the initialization flag corresponding to the process of taking the second sample. Next, the process passes to an initialize flag determination (116), where the number of current thickness initialization flags is compared to a predetermined maximum. If the current flags exceed the maximum, insert thickness initialization operation (117) is completed. If the current flags do not exceed the maximum, successive sampling will continue until the condition is satisfied. Applicants have programmed the present invention to carry out four sampling cycles before the initialization process is deemed completed.

Returning now to FIG. 10A, with the thickness initialization process completed, insert thickness initialization determination (106) will route a new cycle to thickness comparison determination (111). If the thickness is greater than 1.5 times the stored value, the process will pass to mark envelope and increment eject flag operation (101). In this case, the gripped "sheet" is likely a "double", including two or more sheets, rather than a single sheet (see, for example, FIG. 3). If the thickness is not greater, then the process will pass on to thickness comparison determination (112).

If the thickness is determined to be less than 0.5 times the stored value, the process will pass on to mark envelope and increment eject flag operation (102). This determination is typically made if the picking cycle results in a "miss", because no sheet has been gripped by the gripper jaw assembly. However, if the thickness is determined to be greater, the process will continue to eject flag clear operation (118). This will clear all existing eject flags, and also completes the fault detection process. In this case, the sheet 29 or insert is passed along to the conveyor 66 for collation with other sheets, into an insert package 22. Since the package has not been marked for ejection or outsorting, it will be loaded into an envelope at inserter station 70, and sealed shut at a downstream envelope sealing station of conventional design.

It will be appreciated then, that we have disclosed a mail inserter machine with an improved sensor system, providing a stable and accurate digital output, for determining the presence and thickness of gripped inserts during a picking cycle. We have also disclosed an automatic initialization and operating system for a mail inserter machine. The automatic initialization procedures provide calibration values both for the gripper jaw zero position, and for a normalized thickness of the sheets or inserts for the particular job. The computerized system taught herein provides for automatic fault detection using those calibration values, and effects outsorting of defective insert packages while allowing the inserter machine to continue operating.

What is claimed is:

1. An apparatus for gripping an individual piece of sheet material, comprising:

a. an elongated picker arm, having a foot portion extending therefrom;

b. a gripper jaw, said jaw being pivotally mounted to said arm and having a bite portion;

c. drive means attached to said jaw, for moving said jaw alternatively, from an open position with said bite portion remote from said foot, to a closed position with said bite portion adjacent said foot and engaging the sheet material therebetween;

d. a sensor in said foot, said sensor being responsive to a relative proximity between said jaw and said sensor, and producing an electrical output signal proportional to said proximity and corresponding to a thickness of said engaged sheet.

2. An apparatus as in claim 1 further including a computer, said computer having an input responsive to said output signal, and said computer further having at least one stored thickness value corresponding to a desired sheet thickness.

3. An apparatus as in claim 2 in which said thickness value is measured and stored during a thickness initialization procedure, by sampling said output signal while a test sheet is grasped by said gripper jaw.

4. An apparatus as in claim 3 in which said computer includes comparison means and logic means, and in which said gripper jaw grasps a sheet after said thickness initialization procedure, and in which said computer makes a comparison between said stored thickness value and the output signal produced by said sensor corresponding to a thickness of the sheet, and determines whether the sheet is acceptable or not.

5. An apparatus as in claim 1, in which said drive means includes a pneumatic actuator.

6. An apparatus as in claim 1 in which said picker arm is driven in reciprocating fashion from a first position adjacent a stack of sheet material where an individual sheet is engaged by said gripping jaw, to a second position adjacent a conveyor where the individual sheet is released from said gripping jaw.

7. An apparatus for singulating individual sheets of film from a stack of sheets and transporting them to a conveyor, comprising:

a. an elongated picker arm having an upper end and a lower end, said arm being pivotally mounted at said upper end for rotation in reciprocating fashion from a first position, in which said lower end is adjacent the stack, to a second position, in which said lower end is adjacent the conveyor;

b. a foot extending from said lower end of said arm;

c. a gripper jaw pivotally mounted to said lower end of said arm, said jaw having a bite portion;

d. reciprocating means for rotating said arm alternatively between said first position and said second position;

e. means for segregating a single sheet of film from the stack, and directing an edge of the segregated sheet toward said gripper jaw;

f. drive means for closing said gripper jaw while grasping the edge of the segregated sheet of film between said bite portion and said foot with said arm in said first position, and for opening said gripper jaw with said arm in said second position;

g. sensor means in said foot, for detecting the distance between said bite portion of said jaw and said foot after said edge is grasped, the distance corresponding to a thickness of the segregated sheet; and, h. means responsive to said sensor means, for comparing the sensed distance to a stored thickness value, and making a determination whether a fault condition exists.

8. An apparatus as in claim 7 in which said sensor means includes a Hall-effect sensor and a magnet adjacent said sensor, and in which said gripper jaw is metal.

9. An apparatus as in claim 7 in which said means responsive to said sensor means includes a computer, said thickness value being stored by said computer during a thickness initialization procedure, during which at least one test sheet of film having a normal thickness is picked up by said gripper jaw and sampled to establish said thickness value.

10. A method for singulating sheets from a stack of sheets and depositing individual ones of them to a conveyor, comprising:

a. establishing a normalized sheet thickness value and storing it as a digital number;

b. segregating at least an edge portion of a lowermost sheet from the stack, and maintaining the edge in spaced relation from the stack;

c. seizing the edge of the sheet between a gripping jaw and a foot;

d. determining the thickness of the sheet using a sensor in said foot and storing the thickness as a digital number;

e. comparing the thickness of the sheet to said normalized sheet thickness value and making a determination whether the sheet falls within a predetermined tolerance range, extending above and below said normalized sheet thickness value;

f. marking the sheet for ejection if the thickness of the sheet falls outside said tolerance range;

g. drawing the sheet away from the stack and depositing the sheet upon a conveyor; and, h. ejecting the sheet from the conveyor if the sheet is marked for ejection.

11. A method for initializing an apparatus for singulating sheets from a stack of sheets and transporting individual ones of them to a conveyor, comprising:

a. seizing an edge of a sample sheet from the stack, between a gripping jaw and a foot;

b. determining the thickness of the sample sheet by measuring the distance between said jaw and said foot using a sensor in said foot;

c. storing the thickness of the sample sheet as a stored thickness value.

12. A method as in claim 11 in which said stored thickness value is stored as a digital number.

13. A method as in claim 11 in which said determining step is carried out using a Hall-effect sensor in said foot.

14. A method as in claim 11, in which said steps (a) through (c) are carried out a plurality of times, and an average of the determined thicknesses is stored as a digital number.

15. A method as in claim 11 further including carrying out the following steps after step (c):

d. releasing the seized sheet;

e. segregating at least an edge portion of a lowermost sheet from the stack, and maintaining the edge of said lowermost sheet in spaced relation from the stack;

f. seizing the edge of said lowermost sheet between a gripping jaw and a foot; g. determining the thickness of said lowermost sheet by measuring the distance between said jaw and said foot using a sensor in said foot; and, h. comparing the thickness of said lowermost sheet to said stored thickness value and making an acceptable/defective determination.

16. A method as in claim 15 further including carrying out the following steps after step (h):

i. drawing said lowermost sheet away from the stack and transporting the sheet to a conveyor;

j. depositing said lowermost sheet upon the conveyor.

17. A method as in claim 16 further including the steps of carrying out steps (e) through (j) a plurality of times, and inserting each sheet deposited on the conveyor into an envelope.

18. A method as in claim 17 further including the step of marking the sheet for ejection each time a defective determination is made, and ejecting from the conveyor, any envelope containing a sheet corresponding to the defective determination.

19. A method for detecting a fault condition during a picking cycle during which a picker arm having a gripper jaw and a foot grasps an individual sheet from a stack of sheets and transports the sheet to a conveyor, comprising the steps of:

a. establishing a stored thickness value in digital form, said value corresponding to the normal thickness of a sheet to be grasped during the picking cycle;

b. grasping an individual sheet from the stack;

c. measuring a thickness for the individual sheet using a sensor in the foot and storing the measured thickness in digital form;

d. determining whether said measured thickness is greater or less than the product of a predetermined factor times said stored thickness value, and marking the sheet for ejection, if said measured thickness is greater.

20. A method as in claim 19, in which said measured thickness is determined in step (d) to be less than the product of a predetermined factor times said thickness value, further including the step of: determining whether said measured thickness is greater or less than the product of a second predetermined factor times said stored thickness value, and marking the sheet for ejection, if said measured thickness is less.

21. A method for initializing an apparatus for singulating sheets from a stack of sheets and transporting individual ones of them to a conveyor, comprising:

a. seizing an edge of a sample sheet from the stack, between a gripping jaw and a foot;

b. determining the thickness of the sample sheet by measuring the distance between said jaw and said foot using a Hall-effect sensor in said foot; and, c. storing the thickness of the sample sheet as a stored thickness value.

* * * * *